US005961230A

United States Patent [19]

Bellotto

[11] Patent Number: 5,961,230

[45] Date of Patent: Oct. 5, 1999

[54] PRINTER WITH A DEVICE FOR CONTROLLING THE VELOCITY OF THE RIBBON

[75] Inventor: Franco Bellotto, Moncalieri, Italy

[73] Assignee: Panini S.p.A., Torino, Italy

[21] Appl. No.: 08/892,915

[22] Filed: Jul. 15, 1997

[51] Int. Cl.[6] ..... B41J 33/36

[52] U.S. Cl. ..... 400/225; 400/636; 400/234

[58] Field of Search ..... 400/223, 225, 400/227, 227.1, 227.2, 232, 234, 636

[56] References Cited

U.S. PATENT DOCUMENTS

| | | | |
|---|---|---|---|
| 3,455,431 | 7/1969 | Martin | 400/223 |
| 4,010,839 | 3/1977 | Guerrini et al. | 400/234 |
| 4,160,410 | 7/1979 | Fichter | 400/223 |
| 4,661,004 | 4/1987 | Applegate et al. | 400/234 |
| 4,747,715 | 5/1988 | Lahr | 400/225 |
| 5,294,203 | 3/1994 | Williams | 400/223 |
| 5,433,539 | 7/1995 | German | 400/225 |
| 5,533,819 | 7/1996 | Watanabe et al. | 400/225 |
| 5,647,679 | 7/1997 | Green et al. | 400/225 |

*Primary Examiner*—Edgar Burr
*Assistant Examiner*—Leslie Grohusky
*Attorney, Agent, or Firm*—Thorpe, North & Western, L.L.P.

[57] ABSTRACT

A printer, in particular of the type used for printing cheques with magnetic ink, comprises a control device for advancing a ribbon at a velocity substantially equal to the velocity of documents. The velocity of documents and the ribbon are controlled by an electronic unit which drives respectively a first motor and a second motor. The control device includes a presser means comprised of a pair of rollers urged against a motor driven roller. This arrangement enables the precise control of the velocity at which the ribbon is advanced. Downstream of the control device, the combined action of a first temporary take up device outside the cartridge and a second permanent take up device inside the cartridge assures the insertion of used ribbon into the cartridge and its winding around a reel by means of a third motor timely controlled by the electronic unit.

5 Claims, 3 Drawing Sheets

PRINTER WITH A DEVICE FOR CONTROLLING THE VELOCITY OF THE RIBBON

DESCRIPTION

The present invention relates to printers in general and in particular to printers used in banking circuits for printing magnetic characters on bank documents such as cheques and the like.

More precisely, the invention relates to printers having a printing ribbon impregnated with ink, in which the printing action is effected by mechanical pressure between the ribbon and the document to be printed, for example by means of a needle printing head.

In printers of this type used for printing magnetic characters on bank documents it is of fundamental importance that the printer is able to respect the international regulations which specify the shape, dimensions and tolerance of the characters. The invention has been developed in particular for printers intended to operate in accordance with international ISO standard 1004–1977 which defines an operative standard for printers and reading machines for banking systems.

The printers used for printing magnetic characters on documents which are subsequently processed by automatic handling systems, must be able to print the characters wholly in accordance with the regulations since, if this were not so, the data could not be read or could be read erroneously by automatic reading systems.

An object of the present invention is to provide a printer giving high quality printing of the characters, particularly with regard to the uniformity of distribution of ink over the surface of each character.

The printer according to the present invention has a control system for controlling the velocity of the ribbon which is synchronised with the velocity of advance of the document to be printed. More precisely, the printer according to the invention includes drive means for moving the documents to be printed at a predetermined velocity along a path of movement and control means for moving the printing ribbon at a velocity equal to the velocity at which the documents are moved.

In a preferred embodiment of the invention, the control device for controlling the velocity at which the ribbon is advanced includes a motor-driven roller intended to cooperate with the ribbon in pure rolling contact therewith.

The printer according to the invention may, to advantage, be provided with a temporary take-up device for the ribbon downstream of the device for controlling the velocity of the ribbon. The temporary take-up device for the ribbon is arranged to activate a motor-driven permanent take-up device for the ribbon when the length of ribbon temporarily collected thereon exceeds a predetermined value.

Figure 1:
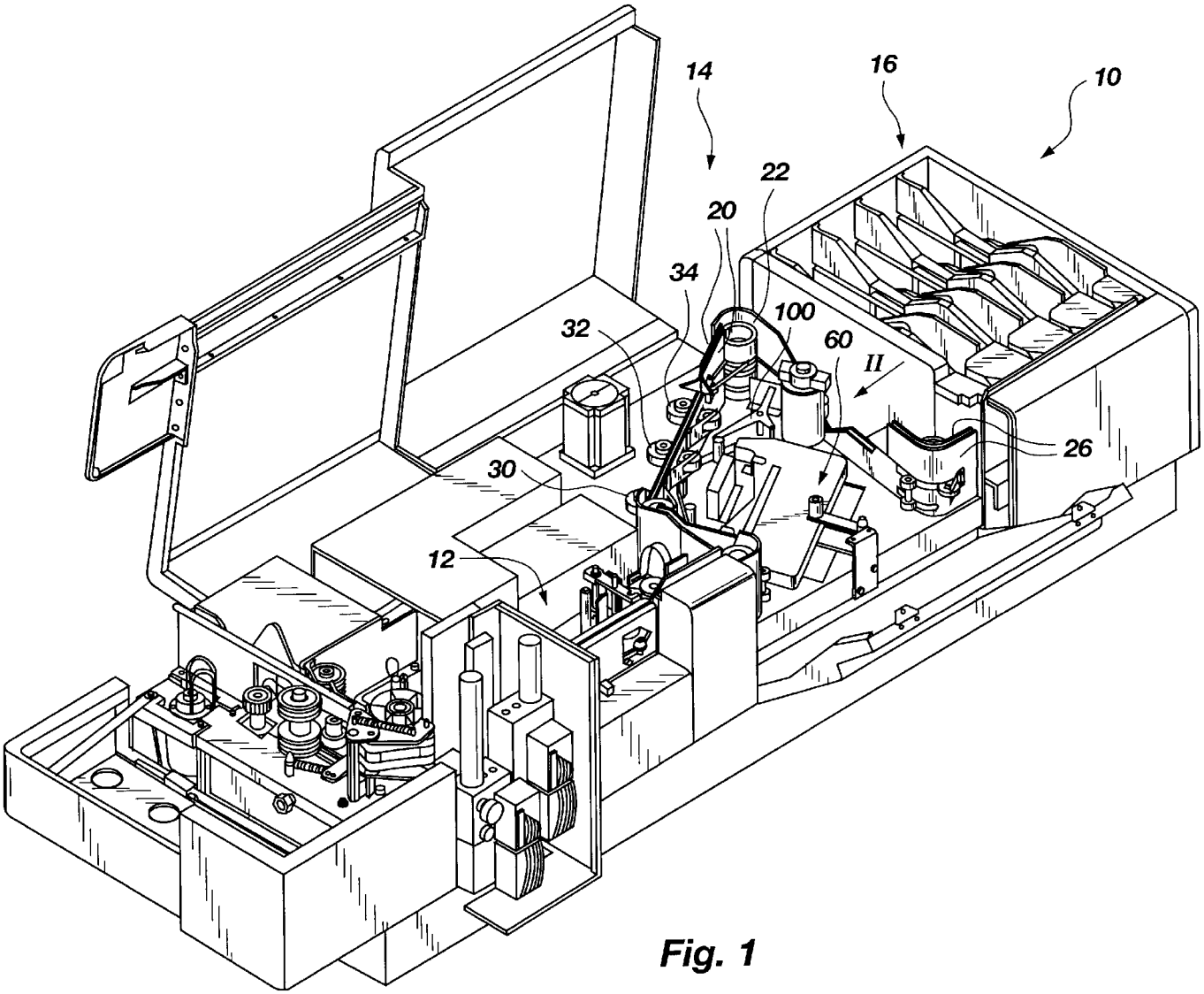
Figure 2:
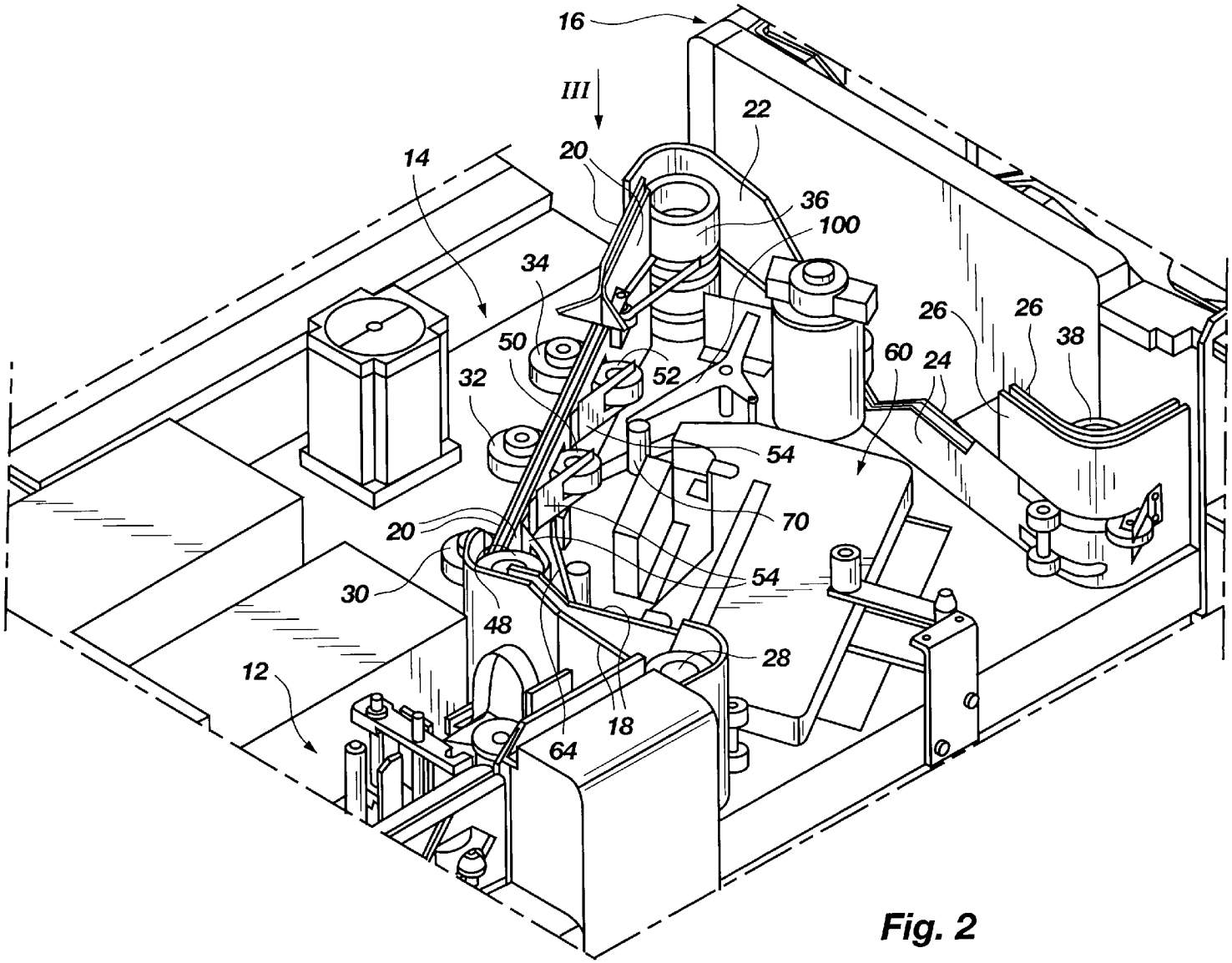
Figure 3:
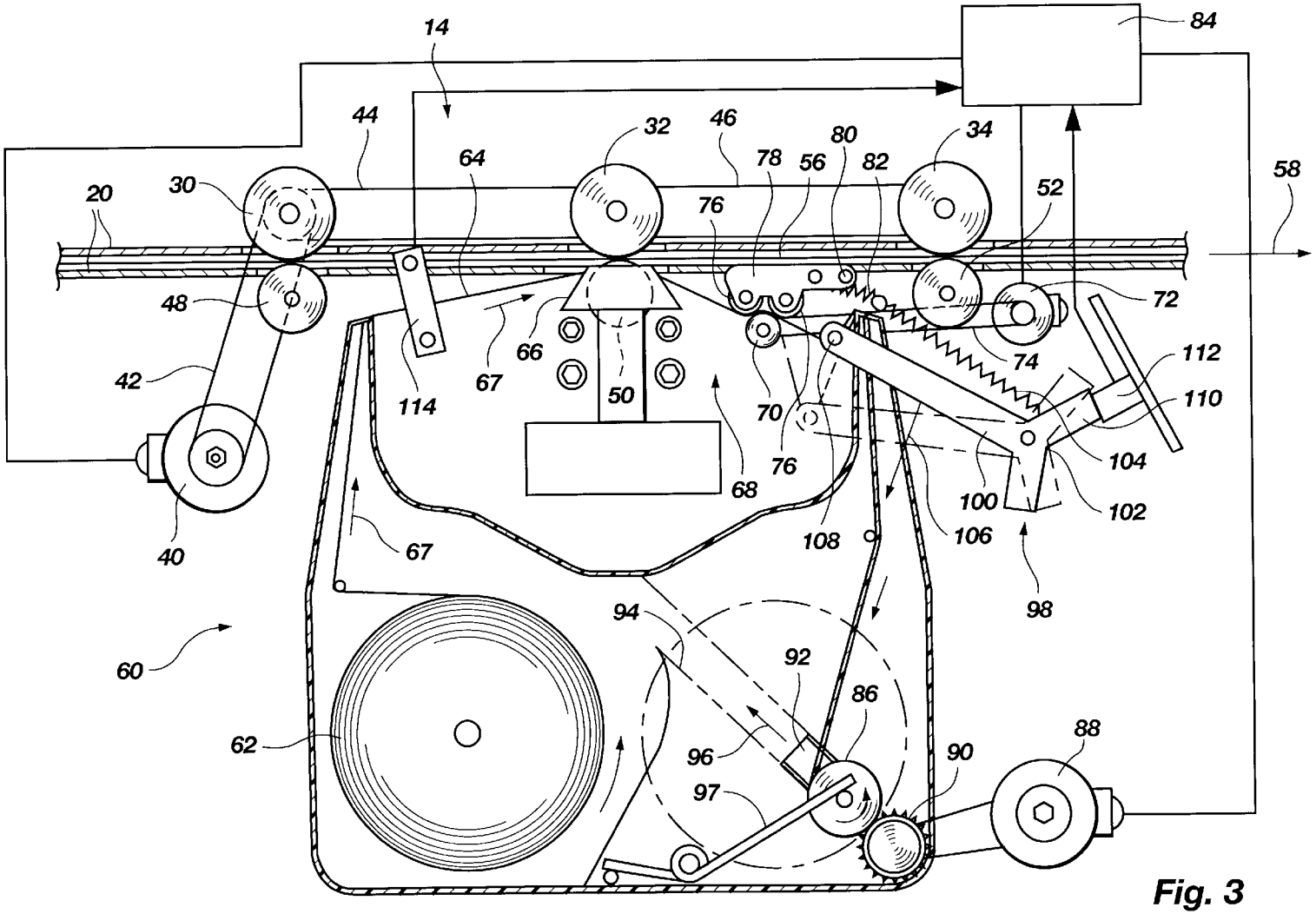

One embodiment of the present invention will now be described in detail with reference to the appended drawings, provided purely by way of non-limitative example, in which:

FIG. 1 is a schematic perspective view of a printer according to the present invention, FIG. 2 is a perspective view of the part indicated by the arrow II in FIG. 1, on an enlarged scale, and FIG. 3 is a schematic plan view taken on the arrow III of FIG. 2.

With reference to FIG. 1, a printer for bank documents such as cheques and the like intended to print on these documents magnetic characters which are readable by automatic handling machines for bank documents is generally indicated 10. The printer 10 includes a casing which houses the electrical, electronic and mechanical elements which control the various functions of the printer.

Basically, the printer 10 includes a section 12 intended to contain the documents to be printed, a printing section 14 and a section 16 for collecting the printed documents, preferably having a series of compartments for receiving different groups of printed documents. The documents are transferred between the supply section 12, the printing section 14 and the collecting section 16 along a path of movement in which there are a plurality of motor-driven rollers for imparting a predetermined transfer velocity to the individual documents which pass in succession through the printing zone 14.

With particular reference to FIG. 2, the transfer path for the documents includes a series of stationary guide elements 18, 20, 22, 24 and 26 which define a vertical slot which connects the supply section 12, the printing section 14 and the collecting section 16 in series with each other. A plurality of motor-driven rollers, indicated 28, 30, 32, 34, 36 and 38, is arranged along the transfer path with their axes vertical. The number and arrangement of the motor-driven drive rollers for the documents are questions of design choice and depend on the shape of the documents to be printed and the relative arrangement of the supply, printing and collecting sections. The arrangement illustrated in the drawings is purely for the purpose of example and it is understood that numerous variations may be made without thereby departing from the scope of the invention.

With reference to FIGS. 2 and 3, the motor-driven rollers 30, 32 and 34 in the printing section 14 are driven by a motor 40, for example through transmission belts 42, 44 and 46. The motor-driven rollers 30, 32 and 34 are associated with respective idle rollers 48, 50 and 52 which are pressed resiliently against the motor-driven rollers 30, 32 and 34 by respective resilient means constituted, for example, by leaf springs indicated 54 in FIG. 2.

The system illustrated is arranged to drive documents, such as that indicated at 56 in FIG. 3, at a predetermined, controlled velocity in the direction indicated by the arrow 58 in FIG. 3.

With reference to FIG. 3, a cartridge 60 is housed in the printing section 14 and contains a reel 62 on which is wound a printing ribbon 64 coated, for example, with magnetic ink. The printing ribbon 64 cooperates with a printing head 66, for example of the needle type. The printing ribbon 64 is driven in the direction indicated by the arrow 67 by a control device 68 adapted to advance the ribbon 64 at a velocity substantially equal to the velocity of the document 56 to be printed. The control device 68 is located downstream of the printing head 66 with reference to the direction of advance of the printing ribbon 64 and includes a roller 70 driven by a motor 72 through a transmission belt 74. The control device 68 includes presser means constituted, for example, by a pair of idle rollers 76 which press the ribbon 64 against the lateral surface of the motor-driven roller 70. The idle rollers 76 are carried by an arm 78 pivoted on the casing of the printer at the point indicated 80. A helical tension spring 82 exerts a resilient force on the arm 78 urging the idle rollers 76 against the motor-driven roller 70. This arrangement ensures pure rolling contact between the printing ribbon 64 and the motor-driven drive roller 70 which enables the velocity at which the ribbon 64 is advanced to be controlled precisely. The motor 40 which drives the document 56 to be printed and the motor 72 which drives the printing ribbon 64 are controlled by an electronic unit 84 which synchronises the velocities of the document 56 and the ribbon 64.

With reference still to FIG. 3, the used ribbon is wound on to a reel 86 located within the cartridge 60. The take-up device for the used ribbon includes a motor 88 which drive s a wheel 90 located within the cartridge 60. The reel 86 on which the used ribbon is wound is carried by a slide 92 slidable along a guide 94 in the direction indicated by the arrow 96. A spring 97 urges the spool of used ribbon which forms on the reel 86 resiliently against the motor-driven wheel 90. The motor 88 which controls the take-up of the used ribbon within the cartridge 60 is activated and deactivated by the electronic control unit 84 in accordance with signals from a temporary take-up device 98 for the used ribbon located downstream of the control device 68 and outside the cartridge 60. The temporary take-up device 98 includes an arm 100 which is rotatable about an axis 102. A helical tension spring 104 urges the arm 100 to rotate in the sense indicated by the arrow 106. At its free end the arm 100 carries a pin 108 which projects perpendicular to the plane of representation of FIG. 3. The pin 108 engages the portion of the used ribbon which extends between the device for controlling the velocity of the ribbon 68 and the inlet section of the cartridge 60. The arm 100 applies a resilient force to this portion of ribbon through the pin 108 and effects a temporary take-up of the ribbon outside the cartridge before the ribbon is finally collected on the reel 86 within the cartridge 60.

The arm 100 has an appendage 110 which cooperates with a stationary sensor 112 constituted, for example, by a light emitter and associated photo-cell. The sensor 112 is able to detect two different operative states of the arm 100 corresponding to different lengths of ribbon temporarily taken-up outside the cartridge. The signal provided by the sensor 112 is sent to the control unit 84 which activates or deactivates the motor 88 which drives the permanent take-up device for the used ribbon, located within the cartridge 60.

When the appendage 110 of the arm 100 is located in correspondence with the sensor 112 (configuration illustrated in full outline in FIG. 3) the motor 88 is deactivated and holds the motor-driven wheel 90 stationary. The resilient force which urges the reel 86 against the wheel 90 brakes the portion of ribbon extending from the take-up reel 86. As the control device 68 for controlling the velocity at which the ribbon is advanced supplies used ribbon, the arm 100 moves progressively in the direction indicated by the arrow 106 in FIG. 3 under the action of the spring 104. This movement of the arm 100 causes progressive movement of the appendage 110 away from the stationary sensor 112. When the arm 100 reaches a position corresponding to a predetermined length of used ribbon temporarily taken up outside the cartridge 60 (corresponding to the position illustrated in broken outline in FIG. 3), the sensor 112 informs the control unit 84 which activates the motor 88 which, through the wheel 90, rotates the take-up reel 86, collecting the used ribbon within the cartridge 60. This action of taking up the ribbon within the cartridge 60 returns the arm 100 to its starting position and, when this is reached, the appendage 110 is again in correspondence with the sensor 112. At this point, the unit 84 deactivates the motor 88. This cycle repeats automatically during the operation of the printer. The roll which forms on the take-up reel 86 increases progressively in diameter as the quantity of used ribbon collected in the cartridge 60 increases. A sensor 114 (for example of optical type) detects the condition in which the fresh ribbon is exhausted and stops the printer. At this point it is necessary to remove the used cartridge and replace it by a new cartridge.

What is claimed is:

1. A printer particularly for printing magnetic characters on bank documents such as cheques and the like, comprising:

drive means adapted to move documents to be printed at a predetermined velocity along a path of movement, said drive means comprising a plurality of motor driven rollers driven by a first motor with a plurality of belts and a plurality of idle rollers resiliently pressed against said plurality of motor driven rollers;

a cartridge containing a ribbon;

control means controlling the velocity at which said ribbon is advanced at a rate substantially equal to the velocity of movement of the document, said control means comprising a pair of idle rollers which press said ribbon against a motor driven roller driven by a second motor;

an electronic unit for controlling said first and second motors and being configured for synchronizing the velocities of the documents and said ribbon; and a device for the take up of the ribbon, said take up device comprising a first temporary take up device outside said cartridge and a second permanent take up device inside said cartridge, said temporary take up device comprising an arm rotatable about an axis and having an appendage which cooperates with a first stationary sensor, said first sensor sending a signal to said electronic unit which controls a third motor driving said permanent take up device for collecting the ribbon.

2. The printer of claim 1, wherein said pair of idle rollers are carried by a pivotally mounted arm, said pivotally mounted arm being resiliently forced by a tension spring in order to urge said pair of idle rollers against said motor driven roller.

3. The printer of claim 1, further including a second stationary sensor for detecting the exhaustion of the ribbon to stop the printer.

4. The printer of claim 1, wherein said temporary take up device is located downstream said control means and further comprises a helical tension spring for urging rotation of said arm and a pin carried by said arm for engaging a portion of the ribbon extending between said control device and an inlet of said cartridge.

5. The printer of claim 4, wherein said third motor rotates a take up reel of said second permanent take up device with a wheel.

* * * * *